United States Patent [19]

Leinberger

[11] 3,936,121

[45] Feb. 3, 1976

[54] JUMPER CABLES FOR SPARKLING POLARITY INDICATOR

[76] Inventor: Gerhard Karl Leinberger, 505 E. Schantz Ave., Dayton, Ohio 45409

[22] Filed: Aug. 19, 1974

[21] Appl. No.: 498,391

[52] U.S. Cl. ..... 339/29 B; 136/181; 320/25; 339/113 R; 339/255 P; 340/249

[51] Int. Cl.[2] ..... H01R 11/22

[58] Field of Search.... 339/28, 29, 113, 147, 255 P, 339/260, 261, 224; 136/181, 182; 320/25; 340/249

[56] References Cited

UNITED STATES PATENTS

| | | | |
|---|---|---|---|
| 3,259,754 | 7/1966 | Matheson | 340/249 |
| 3,267,452 | 8/1966 | Wolf | 339/28 |

*Primary Examiner*—Joseph H. McGlynn
*Attorney, Agent, or Firm*—Biebel, French & Bugg

[57] ABSTRACT

Jumper cables or battery charging cables for automotive use and the like are disclosed in which at least one of the cable's gripper jaws or clamps is provided with a length of coiled heater-resistance wire. The length of wire is clamped to the portion of the jaw handle opposite that to which the jumper cable wire itself is connected, and extends a short distance outwardly of the handle. The coiled heater-resistance wire is chosen as to have a preferred resistance in the order of 0.5 to 2 ohms and has an exposed free end which may be contacted to the battery terminal prior to connecting the gripper jaws to the terminal to indicate whether the charger cables have been correctly or incorrectly connected. If the connection is incorrect, the resistance wire will sparkle visibly and safely at the point of contact with the terminal, thus indicating the the connection is wrong. If no visible sparkle is seen then the charger cables may be clamped with the knowledge that the connection is correct and safe.

4 Claims, 4 Drawing Figures

JUMPER CABLES FOR SPARKLING POLARITY INDICATOR

BACKGROUND OF THE INVENTION

Jumper cables have come into common use for connecting a host battery to a weak battery for the purpose of starting an automobile or the like. It has long been known that there is a danger in making an improper connection. When such a connection is improper, with 12 volt batteries, there is the possibility of a 24 volt short circuit through the jumper cables. Often times due to age or corrosion, it is difficult to read the polarity marking on the terminals. Such a wrong connection may cause injury by reason of an exploded battery, or the acid electrolyte may squirt out of the battery vents. Further, such an improper hookup can damage the charging system of either the automobile containing the host or booster battery or the automobile containing the weak battery.

A number of attempts have been made in the prior art to provide an indication of an improper connection. Wolf U.S. Pat. No. 3,267,452 of 1966 employs a light bulb in one of the handles connecting clamps, and this light bulb is then used to determine whether there is a large volt difference in the circuit to be connected sufficient to light the bulb. The system has the disadvantage of requiring, in the first place, a socket connection separated from the handle for supporting the light bulb itself, and further requires, for the proper operation, that the bulb not be burned out. Also, a light bulb is particularly subject to failure by reason of rough handling or dropping of the cables, or by applying a voltage substantially exceeding the voltage rating of the bulb.

Another lamp type of polarity indicator is shown in Matheson U.S. Pat. No. 3,257,754 of 1966. Here, an electric light bulb is provided with its own separate leads to allow it to be removed and used as a trouble light and to be clamped to either battery.

In Godshalk U.S. Pat. No. 3,389,200 of 1968 there is shown a battery charger with a reverse polarity indicator. The reverse polarity indicator is in the form of an ammeter, and a fixed resistor is received within the handle of the battery charger clamp to limit the current through the ammeter in the event that the charger is being connected in a reverse state.

SUMMARY OF THE INVENTION

The present invention eliminates the difficulties of the prior art battery polarity indicator devices in that it provides a resistance wire, preferably a length of self-supporting coiled electric heater-resistance wire, clamped within one of the handle portions of the battery gripping clamp to provide a means by which the user can quickly, safely, and without ambiguity determine whether the connection is wrong or right. All the user has to do is to make up his connection except for the last connection. Prior to making this connection he simply lightly touches or scrapes the exposed end of the heater resistance wire on the battery terminal. Upon making such contact, if he sees no sparkling, he can safely assume that he has made a proper connection. However, if he observes a bright sparkling at the point of contact of the coiled wire and the terminal, this indicates that the connection is incorrect and that one of the two leads must be reversed. The invention is immune from destruction due to rough handling or misuse.

The invention utilizes commonly available, low cost, coiled heater wire in a length sufficient to extend a short distance outwardly of the unused handle portion of the gripper clamps, and with a resistance between the exposed end and the clamp in the order of 0.5–2 ohms. The actual resistance is not critical within the above range. However, resistances substantially less than 0.5 ohm can permit higher than desired currents to flow, and a resistance substantially in excess of 2 ohms in a 12 volt system or 4 ohms in a 24 volt system will not provide a bright sparkler appearance at the point of contact of the heater wire and the electrode.

It is accordingly an important object of this invention to provide a polarity indicator for jumper cables or battery charger cables which is inexpensive and reliable as a means of indicating a correct connection.

Another object of the invention is to provide a jumper cable having an electrically connected self-supporting length of coiled heater-resistance wire with an exposed end which may be connected with the battery terminal prior to attaching the jaws of the clamp to indicate whether a correct connection is being made.

These and other objects and advantages of the invention will be apparent from the following description, the accompanying drawings and the appended claims.

DESCRIPTION OF THE PREFERRED EMBODIMENT

Figure 1:
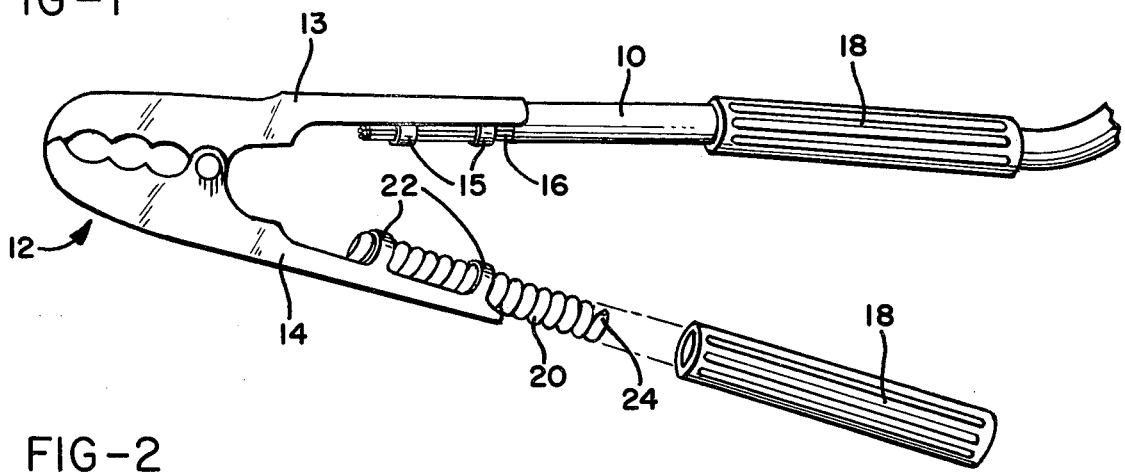
FIG. 1 is a plan view showing the manner in which the resistance wire is connected to one of the handle portions of the gripper jaws.

Referring to the drawings which illustrate a preferred embodiment of my invention, one jumper cable or battery charging cable is illustrated at 10 in FIG. 1 as terminating in a battery terminal gripper clamp or jaw 12. The jaw 12 is formed with a first handle 13 and an opposite pivotally attached handle 14. The handles 13 and 14 in the conventional jumper cable clamp are formed alike and the handle 13 is thus provided with a pair of tabs 15 which engage the bared end 16 of the cable 10. An insulating sleeve 18 is shown as being slipped up the wire in FIG. 1, but in use the sleeve 18 is brought down into telescoping relation over the handle 13.

Figure 4:
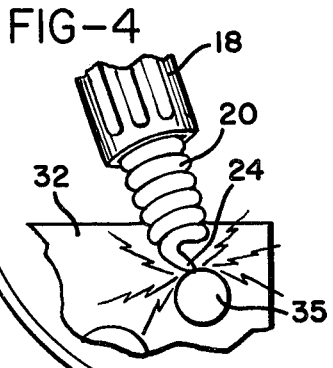

The opposite handle 14 is shown with its sleeve 18 removed to expose the end thereof. A length 20 of coiled, self-supporting heater-resistance wire is electrically and mechanically attached to the handle 14 using the cable-gripping tabs 22. In this manner, a firm mechanical and electrical connection to the coil 20 is provided. As shown, the coil 20 extends rearwardly of the handle 14 by a short distance and terminates in an exposed end 24. When the sleeve 18 is assembled over the handle 14 a portion of the coil 20 is exposed as well as the end 24, as shown in FIG. 4.

The length or coil 20 may have any suitable diameter which provides a reasonable degree of stiffness so that the coil is not too limp to prevent contact being made by the end 24 to one of the battery terminals. For example, it may have a diameter of approximately ½ inch which permits it to be received within and gripped by the tabs 22 of the handle portion 14. Also, the overall length is not critical as long as the desired resistance is achieved between the end 24 and the handle, and this resistance will generally be limited to the portion of the coil which extends outwardly from the point of electrical contact with the handle 14. For example, the length of the protruding portion may be as short as one inch or less or as long as 6 inches or more.

In order to provide the desired sparkling effect to indicate an improper connection, and yet to limit the current to reasonable valves, I prefer that the effective resistance, as measured from the end 24 to the handle 14 be no less than 0.5 ohm and preferably not substantially exceeding 2 ohms, in the case of the jumper cables for 6 and 12 volt batteries. If the cables are to be used in 24 volt systems, such as may be encountered in certain aircraft, heavy duty trucks, earthmoving equipment or the like, I prefer to employ a rail 20 having a resistance range between 1 and 4 ohms.

In the use of my invention, the end 24 is brought into rather light contact with the terminal of the battery to which the clamp will be attached, and the end may be moved across the terminal with a scraping effect, or may be merely placed into and out of contact with the terminal. I have found that the material from which the coil 20 is made is not at all critical in regard to sparking although some materials appear to sparkle more brightly than others. I do consider it important, however, that the resistance provided by the coil 20 is sufficient to prevent undue current flowing. On the other hand, the resistance should not be too high to make it difficult to detect whether there is sparkling when the end 24 is touched or scraped as described above with an improper connection. By selecting a metallic resistor to form an extension of the handle 14 within the resistance range preferred, I provide a means by which a user can readily determine whether his connection is correct or incorrect. The current will not be too high as to cause a self-staining arc or ionized gas region at the point of contact such as occurs in electric arc welding. In other words, I particularly avoid current densities which would cause a welding effect or cause the coil 20 to stick to the battery terminal. Thus, any resistance material may be used for the length 20 which is substantially self-supporting, rugged, and which inherently provides resistance. As explained above, pre-coiled heater wire is preferred for this use since it is available at low cost, readily conforms to the handle 14, and the cable gripping tabs 22, and since it does not interfere with the ordinary use of the gripper jaws 12, it is not subject to destruction due to rough useage, and will not easily break if thrown to the floor or into the bed of a truck, as is so often the case with jumper cables.

While I prefer to use a metallic coiled resistance wire as the resistance element, other suitable rod or extended type resistors, either rigid or semi-rigid, may be employed. Thus, metal impregnated conductive plastics and conductive elastomeric materials may be used. However, I particularly prefer the coiled metallic wire due to its ruggedness, ease of use, low cost, and its ready availability from a number of suitable sources. Further, I prefer that the length of resistance material be attached to the handle 14 itself, as an effective extension of the handle, so that in use, the remaining portion of the handle is covered and protected by the sleeve 18. Thus, when the polarity tester of my invention is used there is almost no chance of the copper gripper jaws coming into inadvertent contact with the battery terminal in case of slippage or incorrect handling. Thus, with my preferred arrangement, there is much less chance of a direct electrical short in the event that the polarity indicator portion slips off of the terminal.

I have found that a wire material consisting of 62 percent iron, 22 percent chromium, 5.5 percent aluminum and 0.5 percent cobalt manufactured and sold by Kanthal Corporation, Wooster Street, Bethel, Connecticut under the tradename "Kanthal" Type A-1 to be highly suitable. I have also found that a resistance wire consisting of 80 percent nickel and 20 percent chromium sold by the above-identified company under the tradename "Nikrothal-8" also to be satisfactory. Further, coiled resistance wire material manufactured and sold by Driver-Harris Company, Harrison, New Jersey, under the tradename "Nichrome" may also be used. "Nichrome" is the tradename of a metallic resistance wire alloy of 60 percent nickel, 16 percent chromium, and 24 percent iron.

Figure 2:
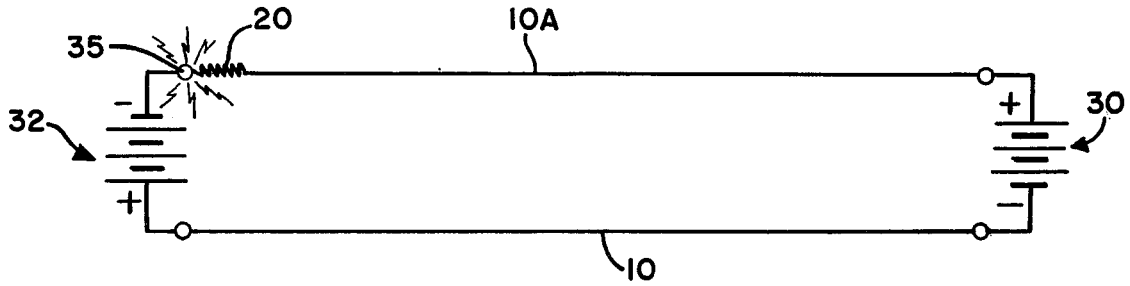
FIG. 2 is an electrically schematic of the view.

FIG. 2 illustrates the situation in which a pair of jumper cables are incorrectly attached. The host battery is indicated at 30 and the receiving battery at 32. One cable 10 has been inadvertently connected between the +terminal of the battery 32 to the −terminal of the battery 30. When the connection is completed using the cable 10A, the end 24 of the coil 20 is momentarily touched or scraped on the −terminal 35 of the battery 30 and an immediate indication is seen due to the sparkling caused by the localized burning and ablasion of the material of the coil 20 at the end 24. The sparkling effect can be readily observed even in daylight and the current is limited to only a few amperes. Such a current level is quite safe to the batteries and to the alternators, diodes, and other electrical components which may be in the automobile's charging circuit connected to either of the batteries. On the other hand, if a proper connection has been made then there would be practically no visible sign of current flow since there would be a minimum of voltage difference, even when connecting to a very weak battery. Should the receiving battery be completely dead, this is not a threat to the donor battery or the alternator or generator, if any, since essentially the same current will flow whether the connection is made right or wrong. Also when connecting to a totally dead battery the current is usually quite low since a wholly dead battery does not readily accept a charge, and exhibits a higher than normal internal resistance.

Figure 3:
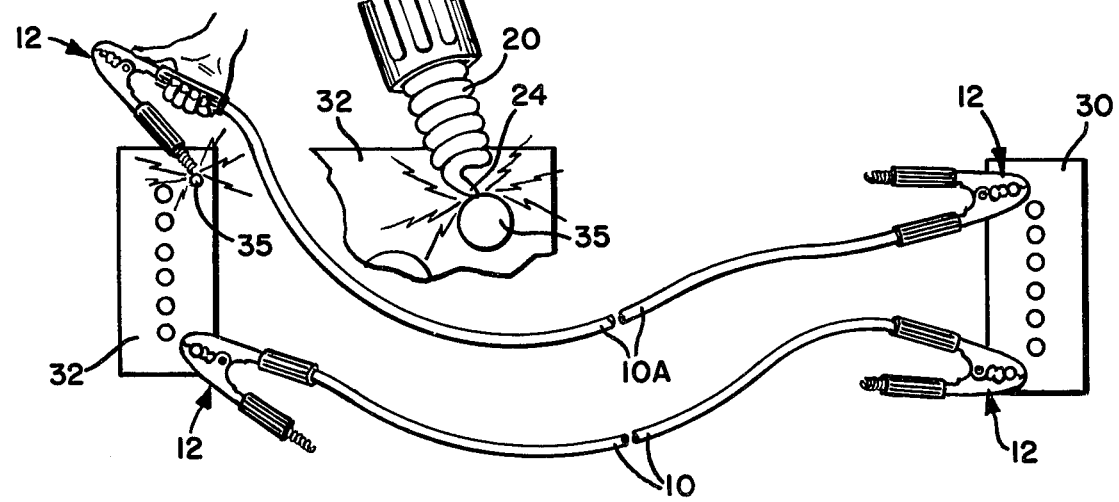
FIG. 3 is a plan view of a pair of jumper cables according to my invention showing the manner in which the invention is used; and, FIG. 4 is an enlarged fragment of a portion of FIG. 3.

Referring to FIG. 3, I have shown a pair of jumper cables in which each of the gripper jaws 12 has been provided with the length 20 of coiled resistance material. This is a totally practical arrangement since the cost of the material comprising the coil is relatively low and thus all of the terminal gripping jaws may be provided with the polarity tester of my invention, one jaw being used to test polarity in the manner illustrated in FIG. 4. The enlarged view in FIG. 4 illustrates the manner of touching the end 24 of coil 20 to the last terminal to be connected prior to actually making a connection. The jaw 12 is merely held by the handle 13 and the end 24 brought into contact with the binding post and scraped to observe whether a sparkling effect occurs. If such occurs as illustrated in FIG. 4 it is then only necessary to reverse the connection at one of the two batteries. If no such effect occurs the gripper jaw may then be attached to the battery terminal 35 in the conventional manner.

While the form of apparatus herein described constitutes a preferred embodiment of the invention, it is to be understood that the invention is not limited to this precise form of apparatus, and that changes may be made therein without departing from the scope of the invention.

What is claimed is:

1. In jumper cables for connection between a pair of storage batteries for applying temporary power from a host battery to a receiving battery, the improvement in polarity detection comprising a gripper jaw having a pair of handle portions and in which one of the connecting cables is attached to one of said portions, a length of coiled resistance wire attached to the other of said handles, said length of wire being essentially self-supporting and extending outwardly of said handle and terminating in an exposed end and having a resistance with the handle in the other of 0.5 ohm to 4 ohms, the end of said wire providing a testing point which sparkles when touched to a battery terminal in which the jumper cables have been incorrectly connected to provide a visual indication of such incorrect connection.

2. A polarity indicator from jumper cables, battery chargers, and the like comprising a battery terminal-engaging clamp, a length of essentially rigid, self-supporting resistance rod attached to said clamp and having an exposed end extending therefrom adapted to be brought into contact with a battery terminal apart from said clamp, said rod being electrically connected to said clamp and having an effective resistance with said clamp in the order of 0.5 ohm to 4 ohms to provide a sparkling effect when the end thereof is touched to the battery terminal if the cables are incorrectly connected while limiting the current under such conditions to prevent damage to the battery and to prevent welding thereof to the terminal.

3. The indicator of claim 2 in which said rod comprises a length of coiled metallic resistance wire.

4. The indicator of claim 2 in which said clamp has a handle portion and a clamping jaw, and in which said rod extends as an effective continuation of said handle portion in a direction remote from said jaw, and an insulating sleeve surrounding said handle portion but exposing said end of said length of rod.

* * * * *

UNITED STATES PATENT AND TRADEMARK OFFICE

CERTIFICATE OF CORRECTION

PATENT NO. : 3,936,121

DATED : February 3, 1976

INVENTOR(S) : Gerhard Karl Leinberger

It is certified that error appears in the above-identified patent and that said Letters Patent are hereby corrected as shown below:

Claim 1, Column 5, line 20, "other" should be -- order --.

Claim 2, Column 6, line 1, "from" should be -- for --.

Signed and Sealed this

*twenty-seventh* Day of *April 1976*

[SEAL]

*Attest:*

RUTH C. MASON
*Attesting Officer*

C. MARSHALL DANN
*Commissioner of Patents and Trademarks*